United States Patent [19]

Kawatsura et al.

[11] Patent Number: 4,907,031

[45] Date of Patent: Mar. 6, 1990

[54] COPY APPARATUS HAVING A PRIORITY COPY INTERRUPT AND MALFUNCTION DETECTION SYSTEM

[75] Inventors: Yoshihiro Kawatsura, Kawasaki; Katsuichi Shimizu, Hoya; Hisashi Sakamaki, Yokohama, all of Japan

[73] Assignee: Canon Kabushiki Kaisha, Tokyo, Japan

[21] Appl. No.: 253,329

[22] Filed: Oct. 3, 1988

Related U.S. Application Data

[63] Continuation of Ser. No. 910,855, Sep. 24, 1986, abandoned, which is a continuation of Ser. No. 608,124, May 8, 1984, abandoned, which is a continuation of Ser. No. 231,030, Feb. 3, 1981, abandoned, which is a continuation of Ser. No. 972,815, Dec. 26, 1978, abandoned.

[30] Foreign Application Priority Data

Dec. 29, 1977 [JP] Japan ..... 52-160280

[51] Int. Cl.[4] ..... G03G 21/00

[52] U.S. Cl. ..... 355/206; 355/207; 355/311

[58] Field of Search ..... 355/3 R, 14 R, 14 C, 355/204, 205, 206, 208, 207, 308, 309, 311

[56] References Cited

U.S. PATENT DOCUMENTS

| | | | |
|---|---|---|---|
| 3,682,544 | 8/1972 | Glaser | 355/14 |
| 3,806,242 | 4/1974 | Reehil | 355/14 R |
| 4,008,957 | 2/1977 | Summers | 355/14 R |
| 4,054,380 | 10/1977 | Donohue et al. | 355/3 R X |
| 4,090,787 | 5/1978 | Hubbard et al. | 355/14 R |
| 4,099,860 | 7/1978 | Connin | 355/14 C |
| 4,105,914 | 8/1978 | Murata et al. | 355/14 CU X |
| 4,128,756 | 12/1978 | Nagano et al. | 355/14 CU X |

*Primary Examiner*—Fred L. Braun

*Attorney, Agent, or Firm*—Fitzpatrick, Cella, Harper & Scinto

[57] ABSTRACT

An image forming apparatus capable of interrupting a copying operation for a priority copying operation includes a first key for entering a desired number of copies, a second key for causing the start of a copying operation, a third key for interrupting a first copying operation initiated in accordance with operation of the first and second keys in order to enable a second or priority copying operation, a fourth key for stopping the first copying operation and control circuitry responsive to the various key operations. Operation of the third key to interrupt a copying operation causes a memory to store the number of repetitions needed to complete the first copying operation. The memory also stores the number of copies for the second copying operation upon operation of the first key after operation of the third key prior to the start of the first copying operation. Operation of the second key after completion of the second copying operation completes or commences the first copying operation. When the fourth key is operated during the priority copying operation, the first copying operation is resumed. The copying operation in progress when a malfunction occurs is resumed after the malfunction is corrected.

36 Claims, 12 Drawing Sheets

MEMORY – MAP

COPY APPARATUS HAVING A PRIORITY COPY INTERRUPT AND MALFUNCTION DETECTION SYSTEM

This application is a continuation of application Ser. No. 910,855 filed Sept. 24, 1986 which is a continuation of Ser. No. 608,124, filed May 8, 1984, which is a continuation of Ser. No. 231,030, filed Feb. 3, 1981, which in turn is a continuation of Ser. No. 972,815, filed Dec. 26, 1978, all now abandoned.

BACKGROUND OF THE INVENTION

1. Field of the Invention

This invention relates to reproduction apparatus capable of performing continuous reproduction.

2. Description of Prior Arts

It has heretofore been necessary that, when a copying operation becomes necessary for an original image having higher priority in its order than the one already put in reproduction operation for multiple copying, the multiple copying of the image original in the reproduction operation is once stopped to cede to the copying operation of the image original of the higher priority, and, upon termination of the interruption copying operation, the numerical key is placed anew to set the number of copy sheet and size for re-starting the multiple copying operation. In this case, an operator of the multiple copying operation is required to memorize the set number of the reproduction sheet and the size thereof immediately after its interruption due to the priority copying operation is terminated, because these numerical data which have once been set for the multiple copying operation are extinguished by this interruption. This is very inconvenient for continuing the multiple copying operation.

When the number of reproduction is very large, such interrupted copying operation is not always limited to a single occasion, but it occurs for several times. In such an instance, it becomes annoying for the operator to memorize and control the set number of copying sheet at the time of the interruption and the number of copying sheet after termination of the interuption copying every time such intervention takes place.

SUMMARY OF THE INVENTION

It is an object of the present invention to provide image forming apparatus which is free from the above-described disadvantage, and which facilitates the interruption copying.

It is another object of the present invention to provide image forming apparatus which is capable of discontinuing or interrupting a reproduction operation in the first mode to cede to a reproduction operation in the second mode, and of resuming the reproduction operation in the first mode after termination of the reproduction in the second mode.

It is still another object of the present invention to provide image forming apparatus which has a plurality of instruction devices for discontinuing the reproduction operation, by the first instruction device of which reproduction operation in one mode is made possible, and by the second instruction device of which the reproduction operation in that mode is released.

It is another object of the present invention to "provide" image forming apparatus which is capable of executing the reproduction operation in the second mode without cancelling the reproduction operation in the first mode prior to execution of the first mode operation, and of continuously executing the reproduction operation in the first mode after termination of the reproduction operation in the second mode.

It is still another object of the present invention to provide reproduction apparatus which displays the contents of the first mode during execution of this first mode reproduction operation, displays the contents of the second mode reproduction operation during its execution by discontinuing the first mode reproduction operation, and displays again the first mode operation prior to the interruption after termination of the second mode reproduction operation.

It is a further object of the present invention to provide reproduction apparatus which, after interruption of the reproduction operation in one mode by a key and other interrupting device, performs a reproduction operation in another mode (such as the number of reproduction sheets, size, paper feeding port, etc.) by designation of such a mode, and, after termination of the reproduction operation in that another mode, resumes the reproduction operation in the previous mode before the interruption (such as set number of reproduction sheets, size of the sheet, paper feeding port, and the number of sheet as reproduced upto the interruption).

DESCRIPTION OF PREFERRED EMBODIMENTS

Figure 1:
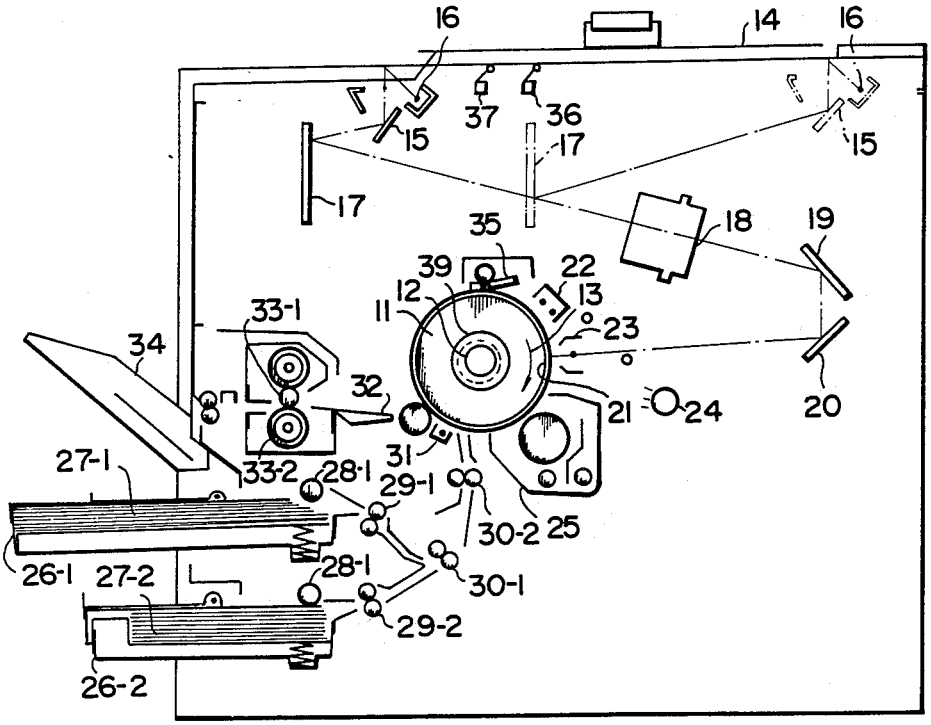
FIG. 1 is a side elevational view in cross-section showing one embodiment of the reproduction apparatus according to the present invention.

FIG. 1 shows a side elevational view in cross-section of the reproduction apparatus in accordance with the present invention.

The surface of a drum 11 consists of a photosensitive body in three-layered structure using CdS photo-conductive substance. The drum is rotatably held on a shaft 12, and is rotated in the direction of an arrow 13 in accordance with a copy instruction.

When the drum 11 rotates to a predetermined position, an image original placed on a glass plate 14 of an image mounting table is irradiated by an illuminating lamp 16 as an integral part of a first scanning mirror 15, and the reflected light is scanned by the first scanning mirror and a second scanning mirror 17. The first scanning mirror 15 and the second scanning mirror 17 move at a ratio of 1: ½, whereby the image original is scanned with the light path length in front of a lens 18 being maintained constant.

The reflected light image passes through the lens 18 and third mirror 19, after which it is focussed on the drum 11 at its exposure section 21 through a fourth mirror 20.

After the drum 11 is charged (in positive (+), for example) by a primary charger 22, it is subjected to a slit-exposure of an image irradiated by the illuminating lamp 16 at the abovementioned exposure section 21. At the same time, charge removal in a.c. or a polarity opposite to that of the primary charge (in negative (−), for example) is carried out by a charge remover 23. Thereafter, the drum 11 is subjected to an overall exposure by an overall exposure lamp 24 to form thereon an electrostatic latent image of a high image contrast. This electrostatic latent image on the photosensitive drum 11 is then rendered visible as a toner image by means of a developer 25.

Image transfer paper 27-1 or 27-2 in a cassette 26-1 or 26-2 is fed into the image forming apparatus by means of a paper feeding roller 28-1 or 28-2, and forwarded in the direction of the photosensitive drum 11 with an approximate timing being taken by the first pair of register rollers 29-1 or 29-2, and then with accurate timing being taken by the second pair of register roller 30-2. Subsequently, the toner image is transferred onto the surface of the image transfer paper 27 on the drum 11 while it is passing through a space between an image transfer charger 31 and the drum 11.

After completion of the image transfer operation, the image transfer paper is guided to a conveyor belt 32, and further led to a pair of image fixing rollers 33-1 and 33-2 where the image thereon is fixed under pressure and heat. Finally, the image-fixed paper is discharged into a paper receiving tray 34.

The drum 11 after completion of the image transfer operation is cleaned its surface by a cleaning device 35 constituted with a resilient blade to be ready for the subsequent reproduction cycle.

At the time of paper feeding, if the image transfer paper is biased or twisted after it leaves the paper cassette, the image transfer paper does not wedge into various conveying rollers such as rollers 29-1, 29-2, 30-1, 30-2, and so forth, and there occurs from time to time jamming of the paper in the vicinity of the rollers. This state is detected and displayed as "jam condition". A reference numeral 39 designates a clock pulse source to generate a series of pulses CP by rotation of the drum. This clock pulse source determines a negative operational timing.

Figure 2:
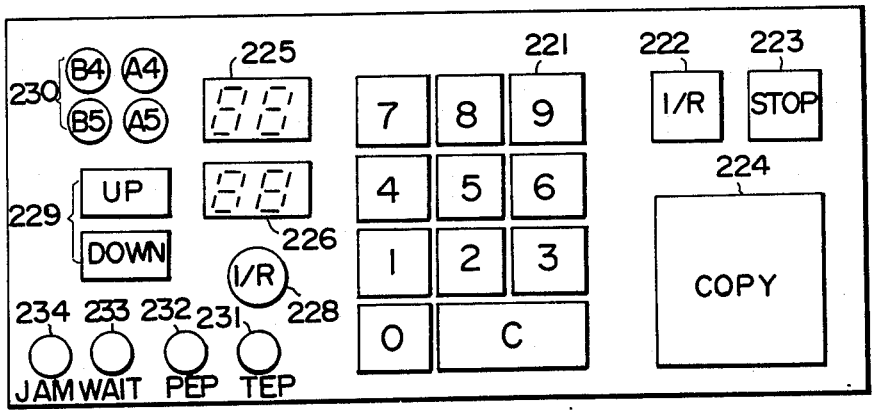
FIG. 2 is a plan view of an operating panel for the reproduction apparatus in FIG. 1.

FIG. 2 shows an operating section for the reproduction apparatus shown in FIG. 1. By depressing any of buttons 0 to 9 in a numerical key board 221, an operator can establish a desired number of copying sheets up to 99 at the maximum, which number is displayed on a display device 225. It should be noted that, when the power source is turned on, the display 225 shows a numeral "1" so that no numerical key needs be depressed, if the number of copy sheet is a unit.

A "CLEAR" key is used when the content of the display 225 is set in "1". A "COPY" key 224 is for conducting the copying operation for a required number as indicated on the display 225. Once this "COPY" key 224 is depressed, the reproduction apparatus starts the copying operation, and the value of a display 226 changes from "0" to "1" when the optical system reaches an inverting position. At a time instant when a numerical value of the display 225 as established coincides with a value of the display 226 showing the number of reproduced sheet, the copy operation mode turns to a post rotation termination mode. And, at a time instant when the copying operation terminates and the photosensitive drum is stopped, the value of the display 226 returns to "0". On the other hand, since the display 225 still retains the value as initially set by the key, if it is desired to make the same number of copies for another image original, the "COPY" key 224 may be depressed again.

During the copying operation, when the "STOP" key 223 is depressed, or any one of displays 231 to 234 is turned on at a time instant when a counted value has not yet reached a set value, the copying operation for one sheet at this time instant is performed, thereby completing the process cycle. Accordingly, when the abovementioned state is brought about at the time of the counted value being "3" with respect to the set value "6", for example, the display 225 shows "6", while the display 226 remains to be "3". When the entire stoppage conditions are dissolved, it is possible to start again from that condition by the "COPY" key 224.

The interruption copying can be done by the use of an "I/R" key. That is, when the set value of the reproduction by the first operator is "6" and its counted value is "3", if the second operator wants to interrupt for two sheets of copies, the "I/R" key 222 is depressed, whereupon the set number "6" and the counted value "3" of the displays 225 and 226 are shunted to other memories to thereby cause "1" and "0" to be displayed on the display 225 and 226, respectively. In this consequence, an I/R lamp 228 is turned on. If the interruption is for a single copy, the "COPY" key 224 may be depressed thereafter, and only one copy can be obtained. If the interruption is for two copies, a set value of "2" is introduced as an input by the numerical key 221, after which the "COPY" key 224 is depressed to complete the two sheets of copying. After termination of the copying, the shunted values of "6" and "3" for the first operator are automatically called back to the displays 225 and 226, respectively, whereby the first operator can again depress the "COPY" key 224 to make the remaining three copies. An indicator lamp 228 "I/R" is turned on when the "I/R" key 222 is depressed, and turned off when the interruption copying is completed or such reproduction is stopped. The abovementioned "STOP" key 223 is capable of dissolving this interruption along with the set number of interruption copying, when it is turned on after instruction for the interruption copying. A "JAM" lamp 234 is immediately turned on when the copy sheet is jammed in the reproduction apparatus, thereby causing the copying operation to shift to its termination mode. A "TEP" lamp 231 is turned on when the toner in the developing device is exhausted. It does not affect start and continuation of the copying operation. A "PEP" lamp 232 is turned on when feed paper is exhausted in a selected paper feeding cassette to prohibit starting of the copying operation, or to terminate continuation of the copying operation. A "WAIT" lamp 223 is kept turned on until a temperature of the image fixing device reaches a desired value to prohibit starting of the copying operation. Once the image fixing device has attained its desired temperature, the copy start (exposure) is made possible and this state is maintained thereafter. A reference numeral 229 designates a selection switch to choose either of the upper cassette and the lower cassette for the paper feed, and numeral 230 refers to an indicator for a cassette size as selected.

Figure 3A:
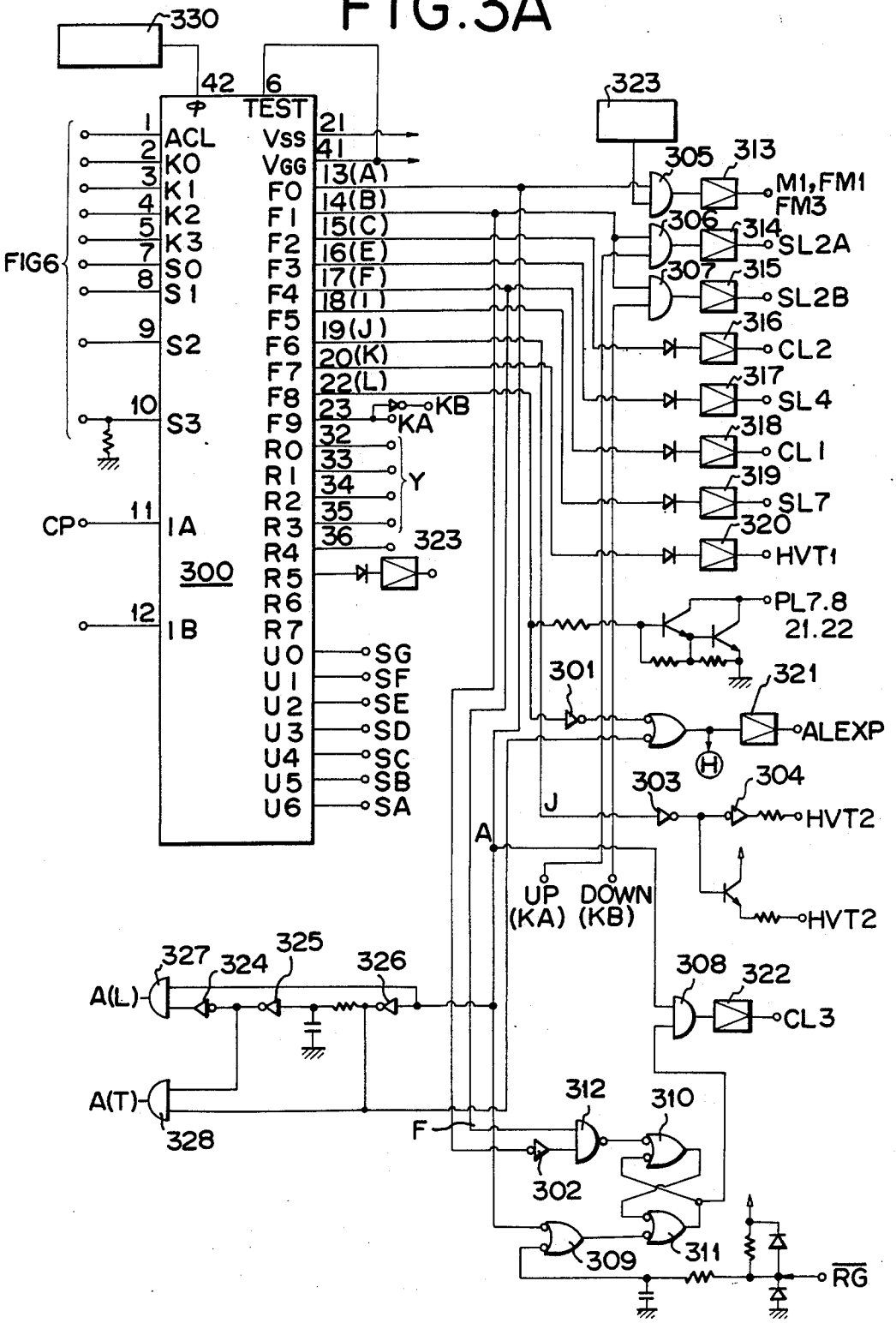
FIG. 3A and B are a schematic diagram of a reproduction control circuit for the apparatus shown in FIG. 1.
Figure 3B:
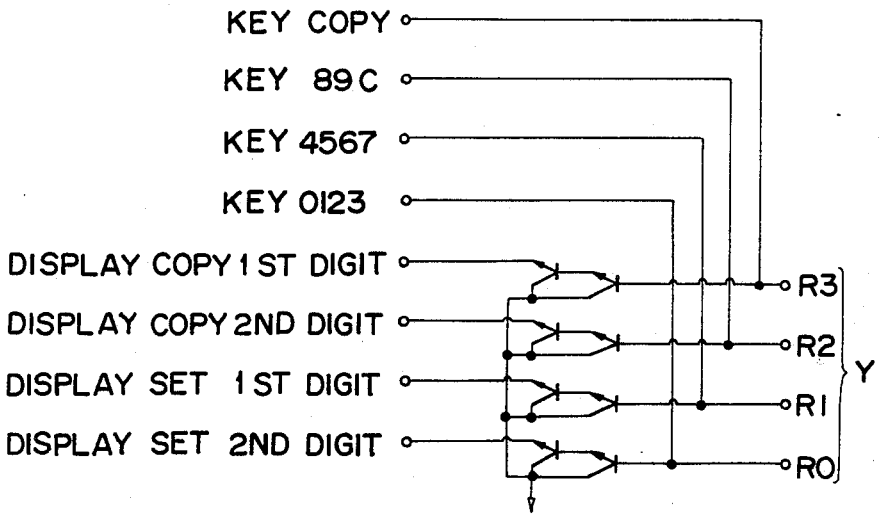
Figure 4:
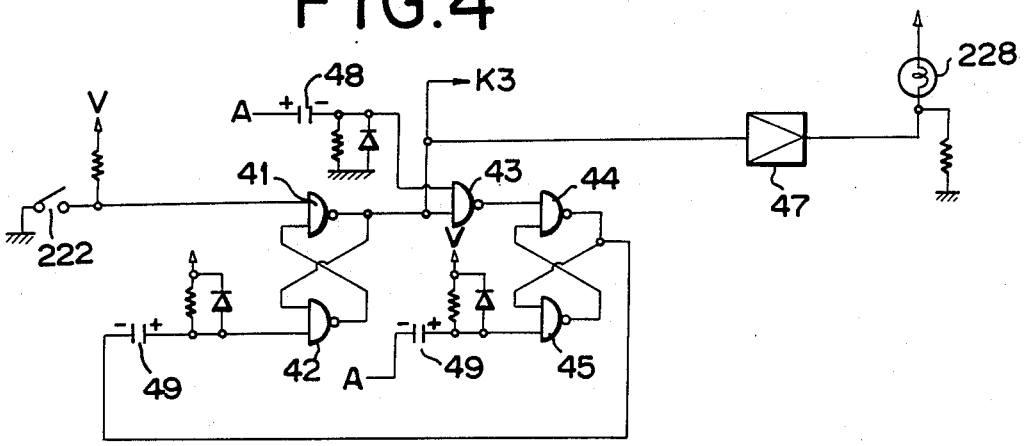
FIGS. 4 and 6 show in schematic diagrams respective embodiments of the interrupting circuits.
Figure 6:
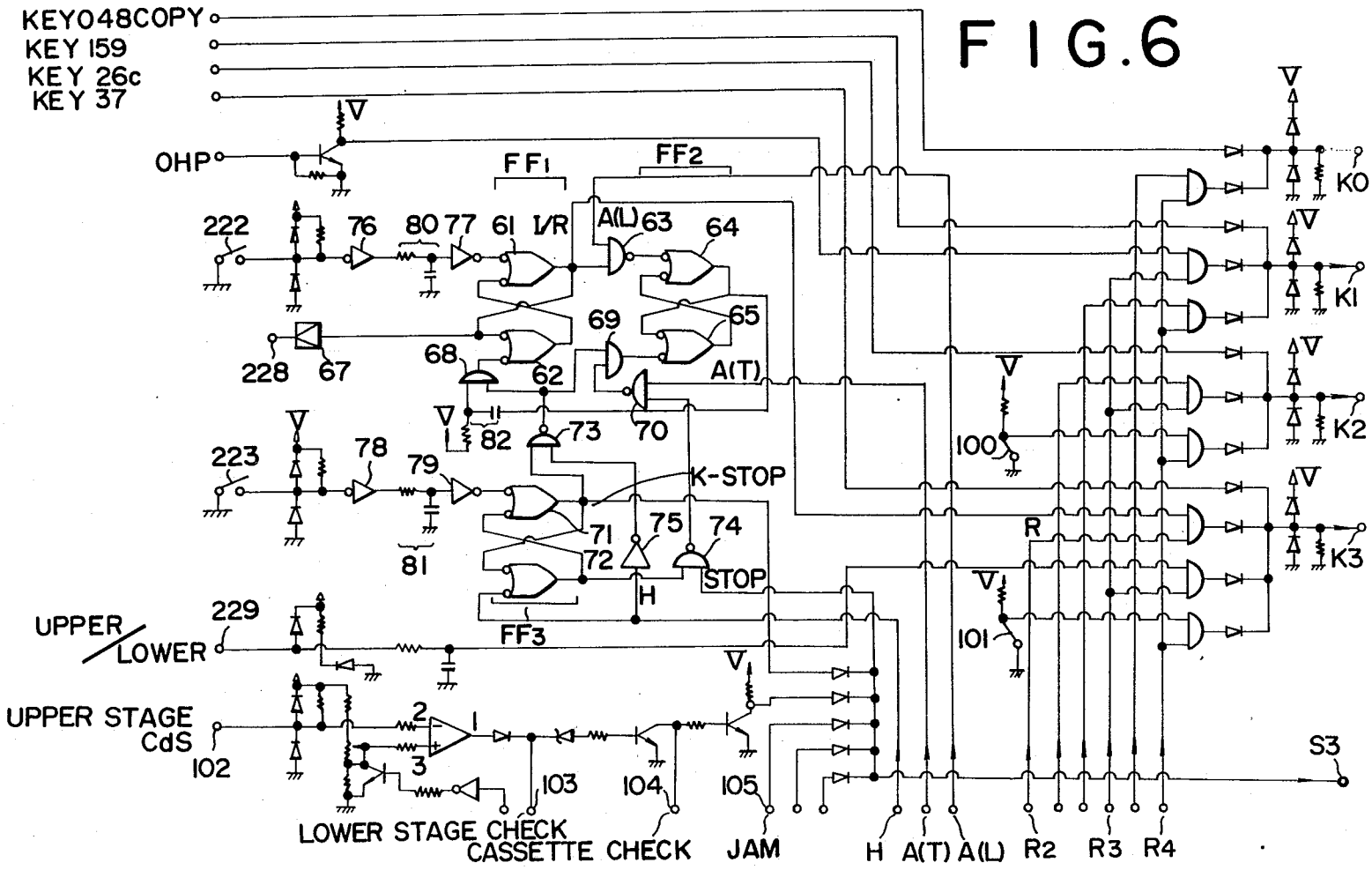

FIGS. 3 and 4 show the control circuits for executing the above-described operations. In the drawing, a reference letter $M_1$ designates a motor drive signal to rotate the photosensitive drum 11, $FM_1$ a fan motor for cooling the interior of the reproduction apparatus, $SL_{2A}$ and $SL_{2B}$ refer to solenoid "on" signals to lower both paper feeding rollers 28-1 and 28-2 for the upper and lower paper feeding cassettes, respectively, $CL_2$ a clutch signal for rotating the register rollers 29-1 and 29-2, $SL_4$ a signal for turning on the lamp 16, $CL_1$ a clutch for causing the optical system 15 to 17 to move forward, $HVT_1$ a power source "on" signal for imparting a high tension voltage to the primary charger 22, H a signal for turning on the overall exposure lamp 24, $HVT_2$ a power source "on" signal to impart a high tension voltage to the secondary charger 23, $CL_3$ a clutch signal to rotate the second register roller 30-2, RG a signal to be obtained from a cam switch 36, and for taking an "on" timing for the second register roller 30-2, OHP a signal for stopping the optical system which is turned on by a cam switch 37 (FIG. 6), and STOP a reproduction stopping signal to be obtained when feed paper is exhausted in the paper feed cassette, or paper jam in the apparatus is detected (FIG. 6). A reference numeral 300 designates a central processing section which produces, as outputs, load control signals A to L and mutually time-sequential, time-division signal Y by means of a memory ROM, in which a sequence timing has been programmed beforehand, and input signals $K_0$ to $K_3$, $S_0$ to $S_3$, IA, and IB from the operating section and the detecting section; 301 to 304 and 324 to 326 refer to inverters; 305 to 309 and 327 to 328 refer to "AND" gates; 310 to 312 refer to "NAND" gates; 313 to 323 refer to amplifiers; 323 refers to an oscillator for a.c. load driving; 330 denotes an oscillator for driving the central processing section 300; A(L) is a rising signal of a main motor signal A; and A(T) is a trailing signal of the main motor signal A. These signals A(T) and A(L) as well as the overall exposure signal H relate to control of the interruption copying, as will be described later on. KA and KB are the signals to designate either the upper cassette or the lower cassette for the paper feeding by a level "1".

The motors $M_1$ and $FM_1$ are controlled by the signal A from the central processing section. The paper feeding solenoids $SL_{2A}$ and $SL_{2B}$ are controlled by a signal B and the paper feeding cassette designating signals KA and KB. The first register clutch $CL_2$ is controlled by a signal C, the lamp 16 is controlled by a signal E, the forward clutch $CL_1$ is controlled by a signal F, the transformer $HVT_1$ is controlled by a signal K, the overall exposure signal H is controlled by an "AND" of the inverting signal of a signal L and the inverting signal of the signal A, the transformer $HVT_2$ is controlled by a signal J, and the second register clutch $CL_3$ is controlled by the output signals A, B and F as well as the detection signal RG. The signals RG and OHP are generated when a cam provided in the optical system passes through the switches 36 and 37. The lamp 16 may be turned on only during forwarding movement of the optical system, hence it may be synchronized with the signal H or F.

The signal OHP is introduced as an input into $S_2$ of the central processing section 300, while the reproduction stop signal STOP is introduced as an input into $S_3$. Output signals from the output ports $U_0$ to $U_6$ are segment selecting signals for the 7-segment indicators 225 and 226, and output signals from the output ports $R_0$ to $R_3$ function as the numerical place selecting signal for the indicators 225 and 226 and the line selecting signal for the well known matrixes with the switch of the key 221 as the intersection there of. In other words, they are the time-division signals for performing the so-called dynamic key input and the dynamic display. Also, the input ports $K_0$ to $K_3$ are for introducing various key input signals shown in FIG. 6.

Figure 8:
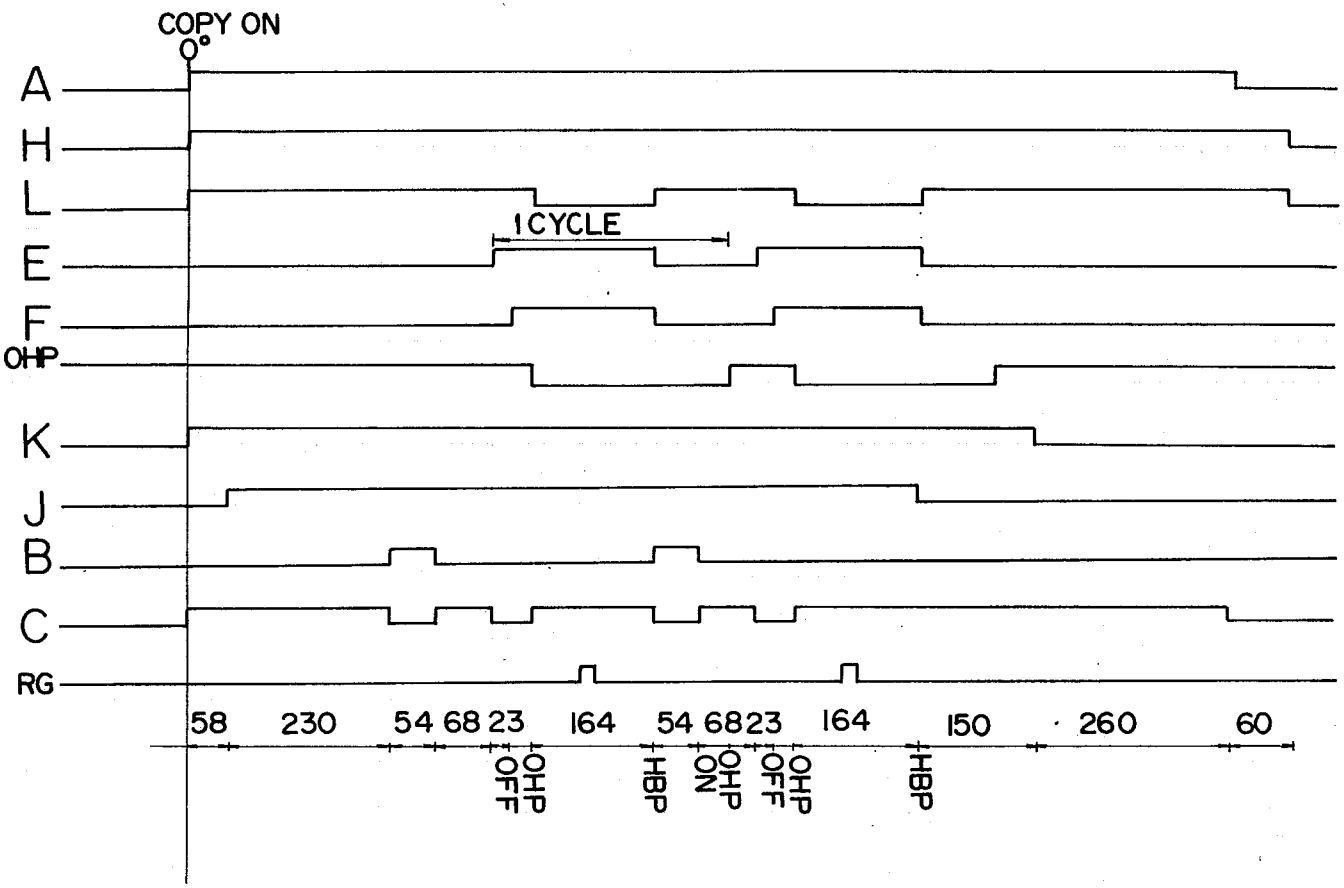
FIG. 8 is an operational time charts for the circuit shown in FIG. 3.

The states of the input and output signals as described above at the time of reproduction, are evident from the time chart shown in FIG. 8, and outputs in accordance with the timings are generated by the programs of the central processing section. In the drawing, the numerical indications denote the clock number CL of the abovementioned drum.

The interior of the central processing section 300 shown in FIG. 3, when a well known micro-computer is used therefor, includes the following components: ROM, RAM, INPUT, OUTPUT, and ADA. ROM is a program memory of the flow chart (FIG. 9) to execute the process sequence, the memory being done by the micro-program in binary codes. RAM denotes a data memory for storing therein data for the program memory and input signal data such as set number for reproduction, number of reproduced sheet, and so on. INPUT designates ports for introducing thereinto the key signals and detection signals as inputs. OUTPUT refers to output ports to latch the output signals. ADA designates a processing section which comprises an accumulator Acc to temporarily store therein data from the input ports and data to the output ports, a decoder to decode the codes in the program memory ROM, and an ALU to operate and logically determine the data from ROM, RAM and input and output ports.

Here, the input data are processed in accordance with execution of the program in ROM, and then taken into the accumulator Acc by a particular step where they are logically determined and forwarded to the subsequent step, thereby controlling the load for the reproduction operation.

Figure 9A:
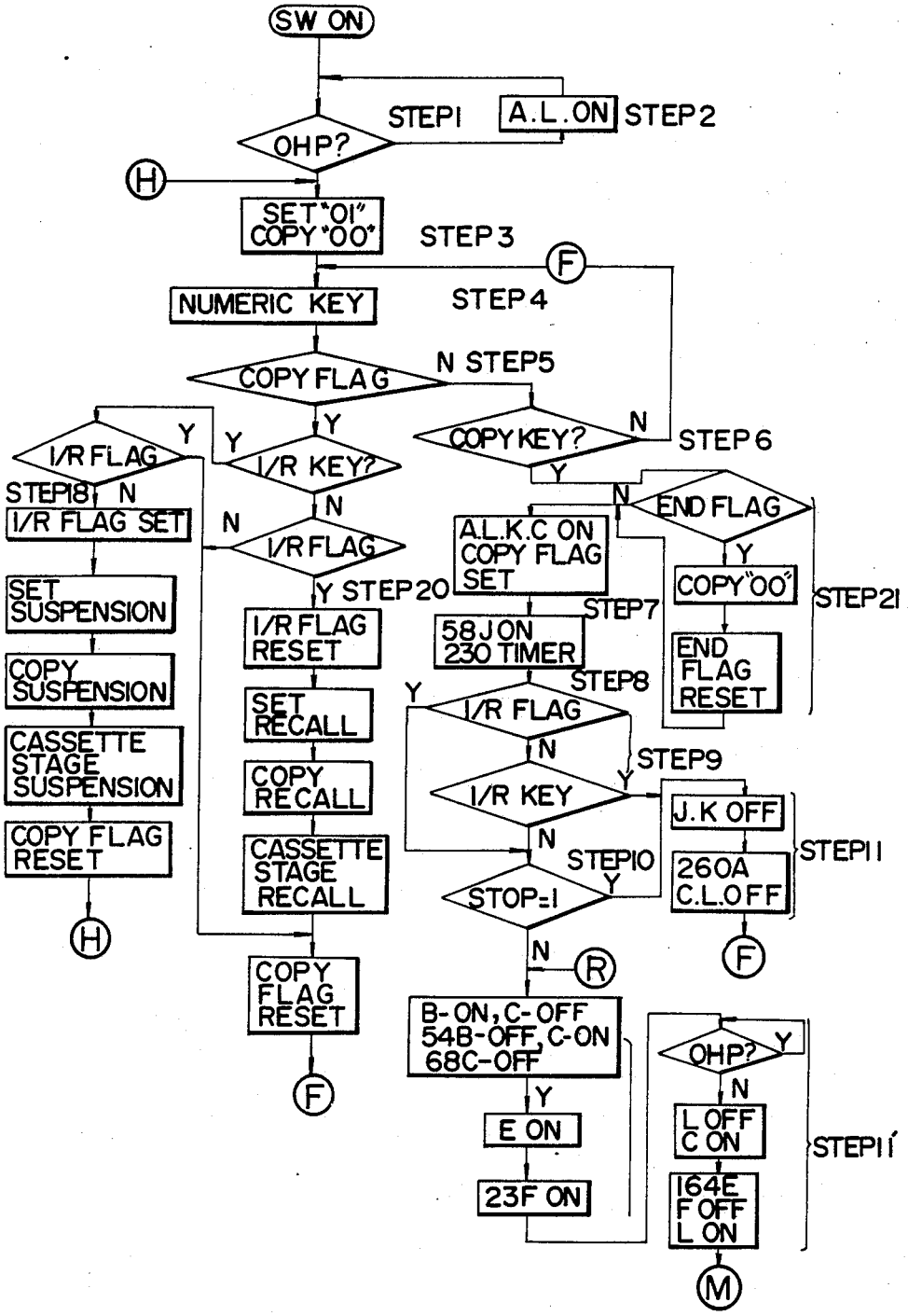
FIGS. 9A and B together show a program flow chart of the CPU in the circuit of FIG. 3.
Figure 9B:
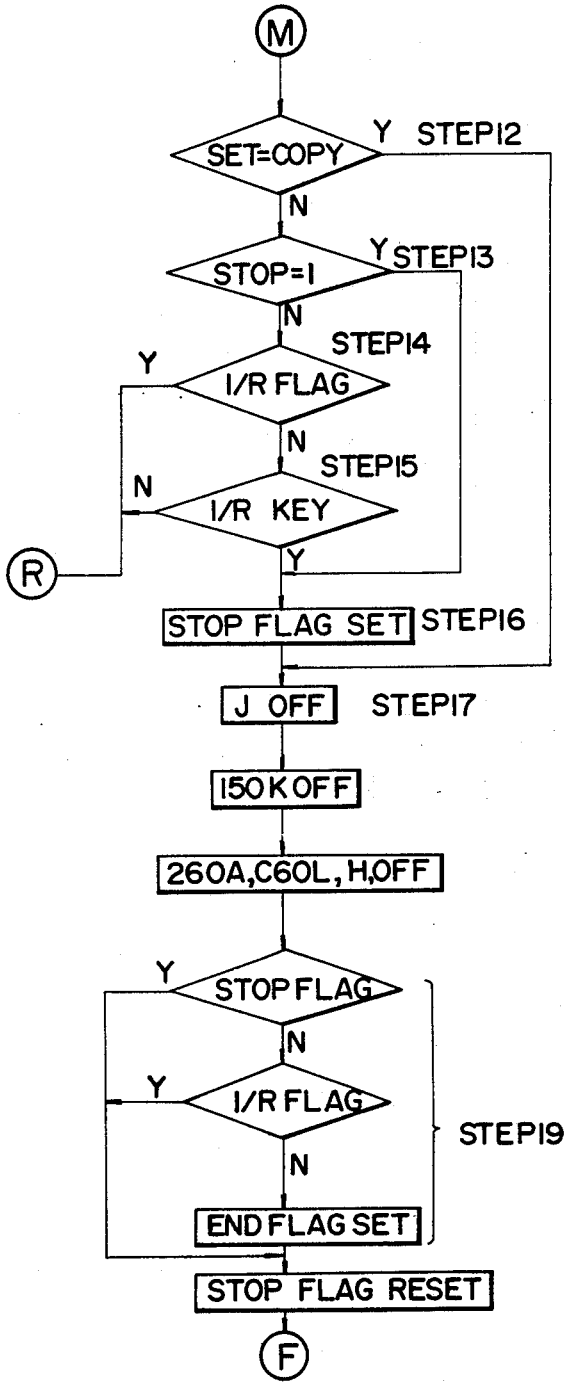

The flow chart in FIG. 9 shows a control flow when the sequence control in FIG. 8, particularly, the sequence control due to interruption input by the I/R key, is effected by the program system. When the main switch SW is turned on, discrimination is first made at the step 1 as to whether the optical system is at its stoppage position, or not. If it is not at the stoppage position, the signal L is turned on to return the optical system to the stoppage position. At the step 3, 01 and 00 are indicated on the displays 225 and 226, respectively, simultaneously storing the numerical figures in RAM. At the step 4, discrimination is done as to whether the cassette key 29 and the numerical key 21 are input, or not. In the meantime, the upper or lower cassette code and the numerical value by these keys 29 and 21 pre stored in RAM, and these are displayed, in the display 225, after which the process proceeds to the step 5. When no numerical key is detected, the process also proceeds to the step 5. The step 5 is a dividing point as to whether the I/R key is to be received, or not. That is, when a "COPY" flag (establishing "1" in the memory) due to the COPY key is not "1", the process proceeds to the step 6 where discrimination is made as to whether an "END" flag due to termination of the copying is "1" or not, and when it is "0", the process proceeds to the step 7 where the output signals A, L, K and C to operate the drum motor, etc. are turned on to start the reproduction operation. Thus, the code "1" is set in the COPY flag.

When this flag is set with the rising part of the I/R signal, the interruption of the key entry is effected. At the step 8, clock is counted for 58, whereupon the signal J to actuate the transformer $HVT_2$ is turned on. When the number 230 is counted up (the numerical value is for CP, which will be the same hereinafter), the I/R division at the step 9 is executed. When the flag due to the I/R key is ?1" and when the I/R key is not detected, the stopped state in the step 10 is detected. This step is such one that detects signals of "no paper", "stop key input", and so forth when they exist, by the detection of which the process proceeds to the step 11 to turn off the signals J, K, A, C and L and to cease the machine operations. Thereafter, the process returns to the key input detection routine at the step 4. In the same manner, when the I/R key input exists, the process returns to the step 4. The subsequent step 11, is for the reproduction cycle to be effected when the optical system starts its forwarding motion, and reaches the inverting position HBP to commence the returning motion. At the step 12, the copy number is incremented by one and compared with the set number for reproduction. If both are not equal, the stop mode is detected to set the stop flag (steps 13 and 16). At the same time, the process proceeds to the steps 14 and 15 to perform discrimination of the I/R key and the I/R flag. When the I/R flag is "1", i.e., during the interruption copying, or when there are no inputs of the stop mode and the I/R key, the process returns to the step 11, where the reproduction is repeated until the set number for reproduction is attained. When the numbers are coincided, the process proceeds to the post rotation cycle of the step 17 et seq. to complete the reproduction. Incidentally, when the I/R key input is received at the step 9, the process returns to the step 4, then proceeds to the step 18 through the step 5, where discrimination is performed for the I/R key "on" to establish the I/R flag, thereby shunting and storing the set number for reproduction, number of reproduced copy, upper and lower cassette (paper size) modes in a different address of RAM. Then, the process returns to the step 3 to perform input of the initial number, the upper and lower cassette (paper size) keys, thereby storing and indicating the interruption mode information in a vacant address in RAM. Upon carrying out the interruption copying, the process proceeds to the step 9 through the same step as mentioned above. Since the I/R flag is set in the step 9, the process proceeds to the steps 10 to 14. By repeating these operations, the interruption copying for the set number is completed. After this, the process proceeds from the step 12 to the reproduction termination step 17 et seq. Then, the process returns to the step 4 without setting the END flag by the step 19. The numerical value as shunted is reinstated to the original address in RAM by execution of the step 20 onward. This is displayed in the display device, after which the process proceeds to the step 6. Thereafter, the copying operation for the remaining number of reproduction is carried out in the same manner as mentioned above, and then the process proceeds to the step 19. At this instance, if no stop flag is set, the END flag is set, whereby the copy number (the display 226) is set in "0" when the process proceeds to the step 6 (step 21). During the interruption copying, when the STOP key is turned on, the process proceeds from the step F to the recall step to release the interruption copying. Also, when the initial I/R key is detected at the step 15, copying operation is done for one sheet at that time, after which the process proceeds to the steps 4, 5 and 18 through the step 19, where the reproduction is executed for the interruption in the same manner as mentioned above. Upon completion of this, the remaining copying is done. Incidentally, the step for indicating the set number for reproduction and the number of reproduced copy as stored in RAM is provided between the steps F and 4, 8 and 9, or in the steps 11, and 11', or in front of the step 19.

FIG. 4 depicts a circuit for performing the interruption reproduction. In the drawing, reference numerals 41 to 45 designate "NAND" gates, which constitute flip-flops (hereinafter abbreviated as "FFs" with 41, 42, 44 and 45. Letter V refers to a power source to apply the level "1". Numeral 47 refers to an amplifier to turn on the display 228 by the interrupting input signal I/R. Numerals 48 and 49 designate a differentiation circuit to generate pulses by the rising and trailing parts of the signal A in each circuit.

When the driving signal A for the main motor and the fan motor is not produced, if the interrupting key 222 is turned on, the state of FF due to the gates 41 and 42 is inverted to produce "1" as an output which is applied to the port $K_3$ as an I/R signal. At the same time, the lamp 228 is turned on through the amplifier 47. In this consequence, the interrupting signal is read in through the abovementioned steps and the set number for reproduction, the number of reproduced copy, etc. are shunted. When the output signal A is generated, an output from the gate 43 is inverted to "0" by the rising part thereof, and the output from the gate 44 changes from "0" to "1". However, no change occurs in the input to the gate 42 by the circuit 49. As soon as the interruption copying terminates and the signal A takes the level "0", the output from the gate 45 takes the level "1" by the pulse due to trailing part of the signal, thereby inverting the output from the gate 44 from "1" to "0". On account of this, the level "1" is instantaneously applied to the gate 42, hence its output takes also the level "1", and the output from the gate 41 changes to the level "0" with the consequence that the interrupting signal I/R is extinguished, whereby the set number for reproduction, the number of reproduced copy, etc as shunted are recalled.

Figure 5:
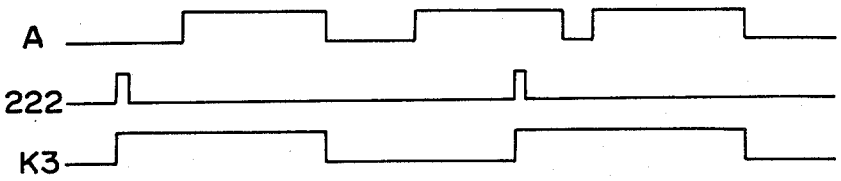
FIGS. 5 and 7 are respectively operational time charts for the circuits shown in FIGS. 4 and 6.

When the interrupting key 222 is turned on, while the signal A is being emitted during the reproduction operation, the flip-flop due to the gates 41 and 42 is set, and an I/R signal output is produced. However, since the state of the gates 44 and 45 does not change, the output therefrom remains at the level "1", even when the copying operation is terminated, and the trailing part of the signal A is introduced as an input into the gate 45. Accordingly, the state of the gates 41 and 42 does not change, and the I/R signal is kept as it is. Accordingly, the process for reproducing one sheet when the interruption is made is completed, and only after it is completed, the process for the interruption copying is performed. The operation time chart for the circuit in FIG. 4 is shown in FIG. 5.

Figure 7:
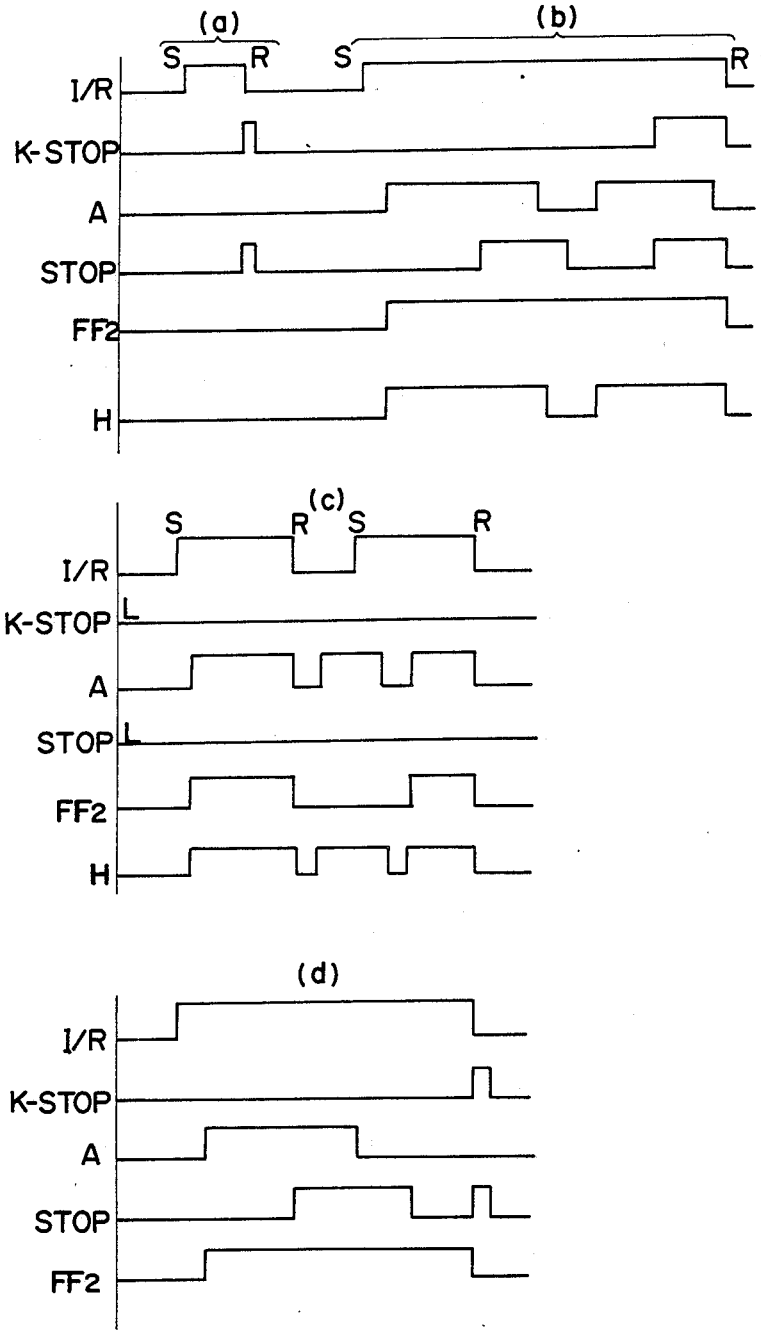

FIG. 6 is another embodiment of the circuit for the interruption reproduction, the operational time chart of which is shown in FIG. 7. The circuit is for releasing the interruption reproduction by the stop key and other stop modes for stoppage of the reproduction. Various release modes will be explained hereinbelow.

a flip-flop $FF_1$ is constructed with gates 61 and 62,
a flip-flop $FF_2$ is constructed with gates 64 and 65,
a flip-flop $FF_3$ is constituted by gates 71 and 72.

Numerals 63, 70, 73 and 74 designate NAND gates. Numeral 69 refers to an AND gate. Numerals 75 to 79 refer to inverters. Numerals 80 to 82 designate differentiation circuits to form trigger pulses. KSTOP is an output signal for $FF_3$ due to the stop key. The STOP signal is a reproduction stop signal from the apparatus, and is formed by paper exhaust signal PEP in the upper and lower cassette, jam signal JAM, and so forth. A(L) and A(T) are respectively the rising and trailing portions of the signal A, and H is an output signal for turning on of the abovementioned overall exposure lamp. "Key 048 Copy" is an input signal by 0-key "on" and $R_0$ signal, 4-key and $R_1$ signal, 8-key and $R_2$ signal, and COPY-key and $R_3$ signal. The same can be said of the other signals.

A mode (a) of the time chart indicates that, after the interrupting key 222 is turned on, when the process is not executed, the interrupting signal I/R is released by turning on of the stop key 223. By turning on of the key 222, $FF_1$ produces an output level "1", whereby the I/R signal is applied to the input port. When the stop key 223 is turned on prior to change of the output from $FF_2$ by A(L), $FF_3$ is set and the output signal KSTOP is produced. Since, however, the overall exposure signal H has not yet been output, $FF_1$ is reset by the KSTOP signal through the gates 73 and 68 to render the I/R signal to be at the level "0". Consequently, what has been shunted in the signal I/R is recalled by the stop key 223. Incidentally, since the signal A(L) is not generated, $FF_2$ is not set. Also, since the input to the gate 72 is at the level "0", $FF_3$ is set only while the stop key 223 is in its "on" state.

The mode (b) indicates that, during execution of the interruption reproduction, a state of "paper exhaustion" takes place that the interruption reproduction is continued after replenishment of the paper, and that the stop key is depressed to release both copying and interruption on the half way. By turning on of the key 222, when $FF_1$ produces an output level "1", the I/R signal is applied to set the number for interruption reproduction, and the reproduction operation commences with depression of the copy button, the signal A is output, whereupon $FF_2$ is set. When the paper becomes exhausted in short of the set number for reproduction, the STOP signal is generated, and, after completion of the reproduction operation for remaining one copy, the copying operation stops. At this instance, there is generated the trailing part A(T) of the signal A. However, since the input of the gate 74 is at the level "1", the outputs of the gates 70 and 69 remain at the level "1", and $FF_2$ is not reset. Accordingly, $FF_1$ is also not reset, and maintains the output of I/R.

Upon replenishment of the paper, "STOP" signal assumes the level "0". When the copy key is depressed, the interruption reproduction operation is resumed for the remaining number of copy. After rising of the signal A, when the stop key 223 is depressed during execution of the reproduction operation, $FF_3$ is set to produce the KSTOP signal output, although $FF_1$ is not reset due to hindrance by the gate 73. In other words, I/R continues its output to execute reproduction process of the remaining one sheet at that time. At the termination of overall exposure H, the output of the gate 73 assumes the level "0" to reset $FF_1$ and $FF_2$. At the same time, $FF_3$ is also reset. As the result, the interruption is released by the stop key 223.

The mode (c) shows that the stop key is not in use as is the case with that in FIG. 5. In FIG. 6, reference numerals 102 and 103 designate sensors to detect exhaustion of feed paper in each of the upper and lower cassettes. Numerals 104 and 105 also refer to sensors which generate the level "1" by the absence of cassette and the paper jamming.

The mode (d) indicates that, after generation of the stop signal such as paper exhaustion, etc., the interruption reproduction thereafter is discontinued by the stop key. After replenishment of the paper, when the stop key is turned on, $FF_3$ is reset, owing to which the input of the gate 73 assumes the level "1" to reset $FF_1$ and $FF_2$ by the output thereof. As the result, the I/R signal is released, and the contents of the memory as shunted is recalled.

Figure 10A:
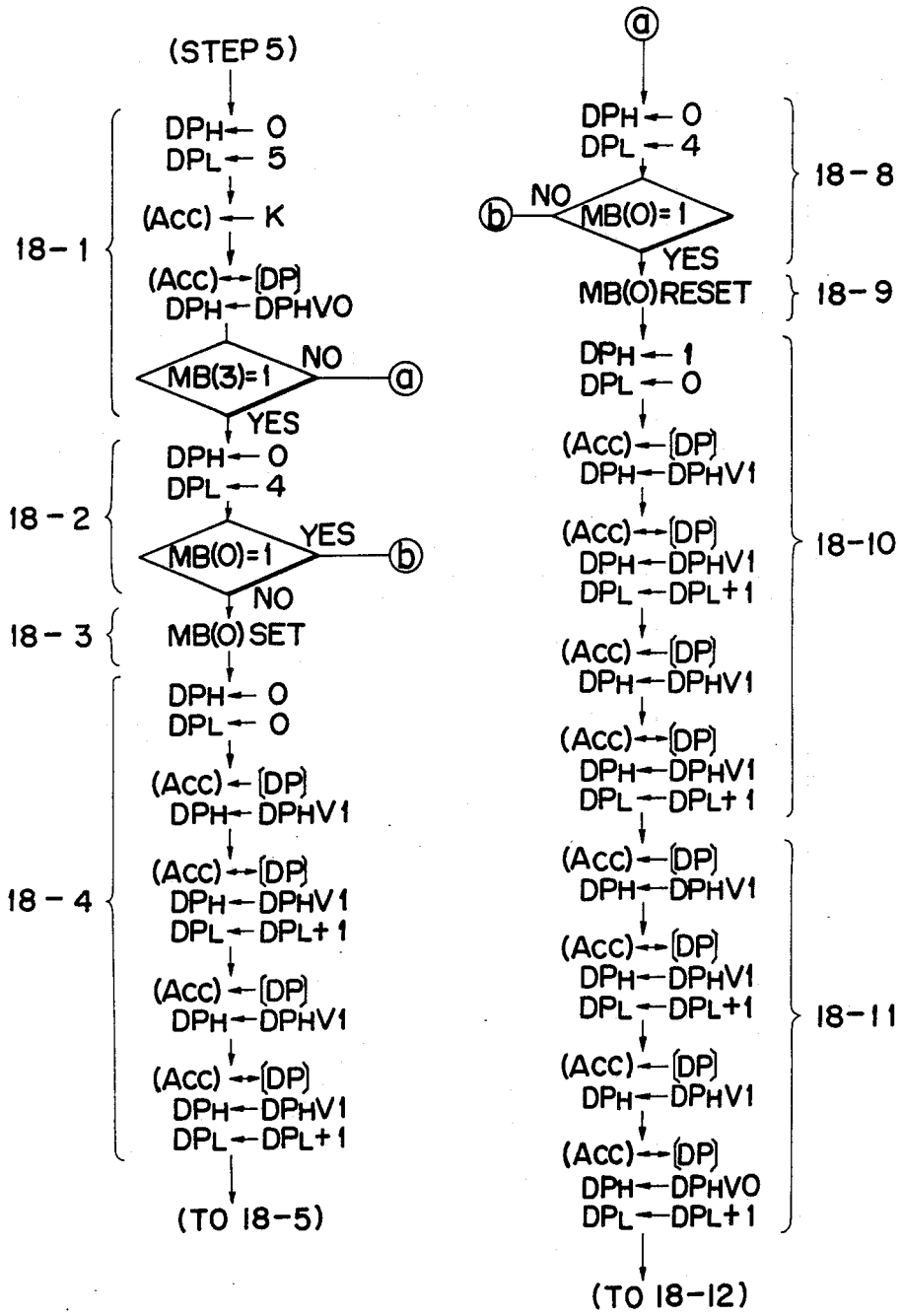
FIGS. 10A and B, 11 and 13 are other flow charts for the circuit in FIG. 3.
Figure 10B:
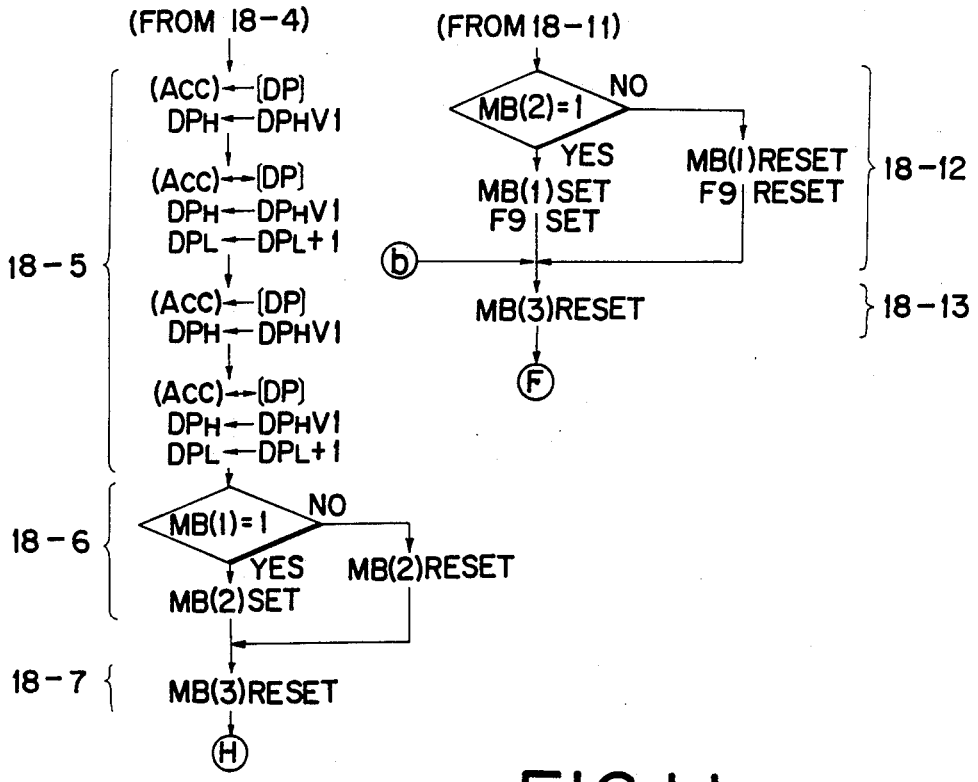
Figure 11:
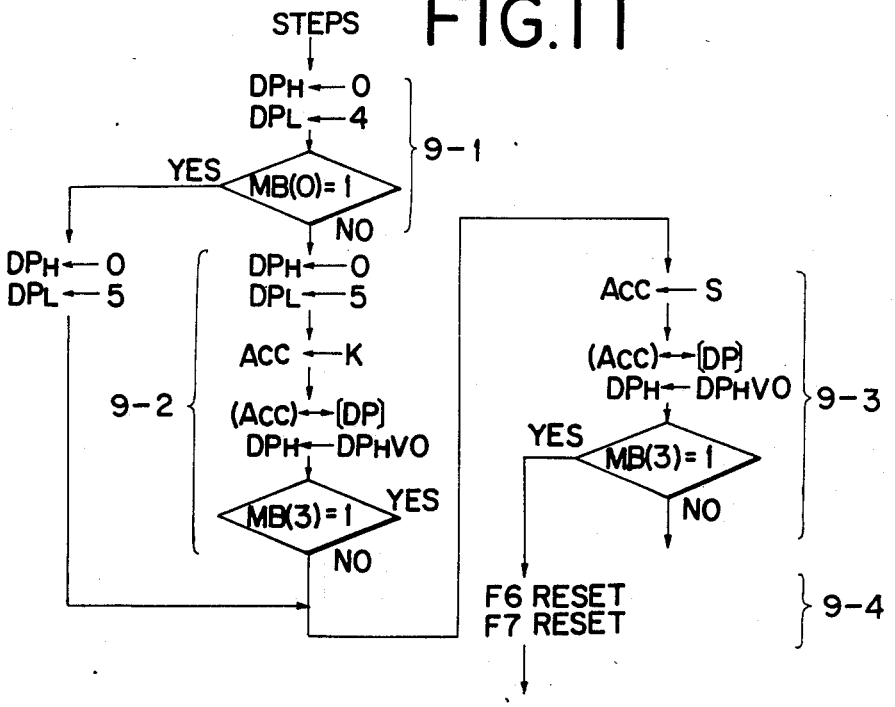
Figure 12:
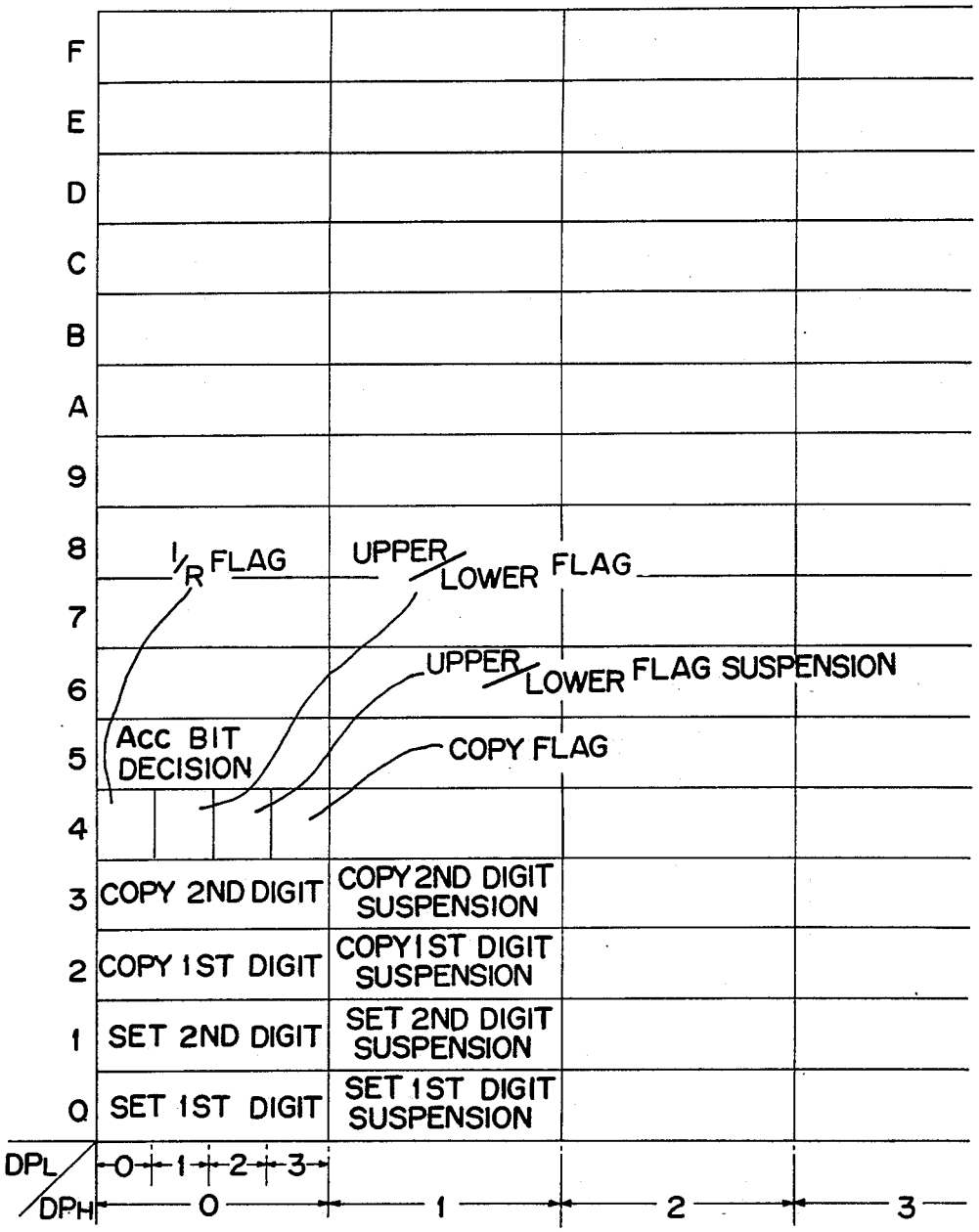
FIG. 12 shows a memory map.

FIGS. 10, 11 and 12 illustrate examples of machine word mode when the process flow in FIG. 9 (a portion related to the interruption reproduction) is executed by using a microcomputer NPD545 (MCOM42) of Nippon Electric Co., Ltd., Japan. Since the invention has been explained in detail in reference to FIG. 9, the explanations that follows will be made as simple as possible. In the flow chart of FIGS. 10, 11 and 12, $DP_H$ and $DP_L$ are registers present in CPU to perform the area designation in memory RAM of CPU and the input and output ports designation of CPU. They are called "data pointer". Addresses of the area in the memory RAM are shown in FIG. 12. Letters Acc refer to an accumulator in CPU. Letters DP denote data of the area in RAM as designated by the data pointers. Letters MB(O) indicate the data at the zero bit in the data. The machine words with each step in FIGS. 10 and 11 as a unit are stored in ROM. CPU reads out these machine words sequentially to execute the operations indicated by each step.

When RAM is cleared in response to a turning on of the power source to the CPU, and the program process proceeds to arrive at the "I/R key check" step, the data in the input port K are stored in the accumulator Acc, and thereafter further stored in the addresses 0, 5 of RAM as designated by the data pointers. Then, discrimination is performed as to whether the level "1" is set in the third bit, or not, i.e., whether the I/R key is turned on (1), or not (18-2). When the I/R key is on, "0" and "4" are set in the data pointers to check the I/R flag at the zero bit. If the flag is set, the copy flag at the third bit in the address is reset, and the process proceeds again to the key entry routine F. If the I/R flag is at 0, it is set (18-3). Then, the first numerical place of the set number for reproduction in the RAM address (0, 0) is shifted to the address (1, 0), the second numerical place of the address (0, 1) is shifted to the address (1, 1) (18-4), and the copy number in the addresses (0, 2) and (0, 3) is shifted to the addresses (1, 2) and (1, 3) respectively to thereby designate the address (0, 4) (18-5), thereby discriminating its first bit, i.e., checking the upper/lower flag indicating either cassette stage prior to the interruption copying. If the upper/lower flag is zero, it means the upper cassette, and therefore the second bit which is the shunting flag of the upper and lower flag is set. On the other hand, when the lower cassette is designated, the second bit is reset (18-6). By resetting the copy flag at the third bit (18-7), the interruption copying becomes possible (H).

At the step 18-1, when the I/R key is detected to be not in its "on" state, the I/R flag is checked in the same manner as in the step 18-3 (18-8). When the flag is set, i.e., when the interruption copying is completed or stopped, it is reset, and the set number for reproduction and the number of reproduced copy which have so far been shunted in the addresses (1, 0), (1, 1), (1, 2) and (1, 3) of RAM are recalled in the addresses (0, 0), (0, 1), (0, 2) and (0, 3), and these are displayed. Then, the shunting flag for the upper/lower cassettes is checked, in accordance with the upper or lower cassette of which the output port F9 is reset (0) or set (1) to selectively operate the paper feeding rollers (18-12). Thereafter, the copy flag is reset (18-13) to return to the key entry routine F.

The flow chart in FIG. 11 relates to the step 9 in FIG. 9, wherein the I/R key is discriminated during the copying operation, and the shunting routine of the abovementioned copy mode is executed. First of all, numbers 0, 4 are set in the data pointers to check the I/R flag in the manner as mentioned above (9-1). When the flag is not set, the "on" state of the I/R key is discriminated (9-2), and the output ports F6 and F7 are reset to turn off the high tension power source (9-4). Thus, the process proceeds to the key entry shunting routine. The process also proceeds to the key entry routine at the time of the stop mode, wherein control of the stop mode such as a stop key, etc. is conducted by reading the input port S.

Figure 13:
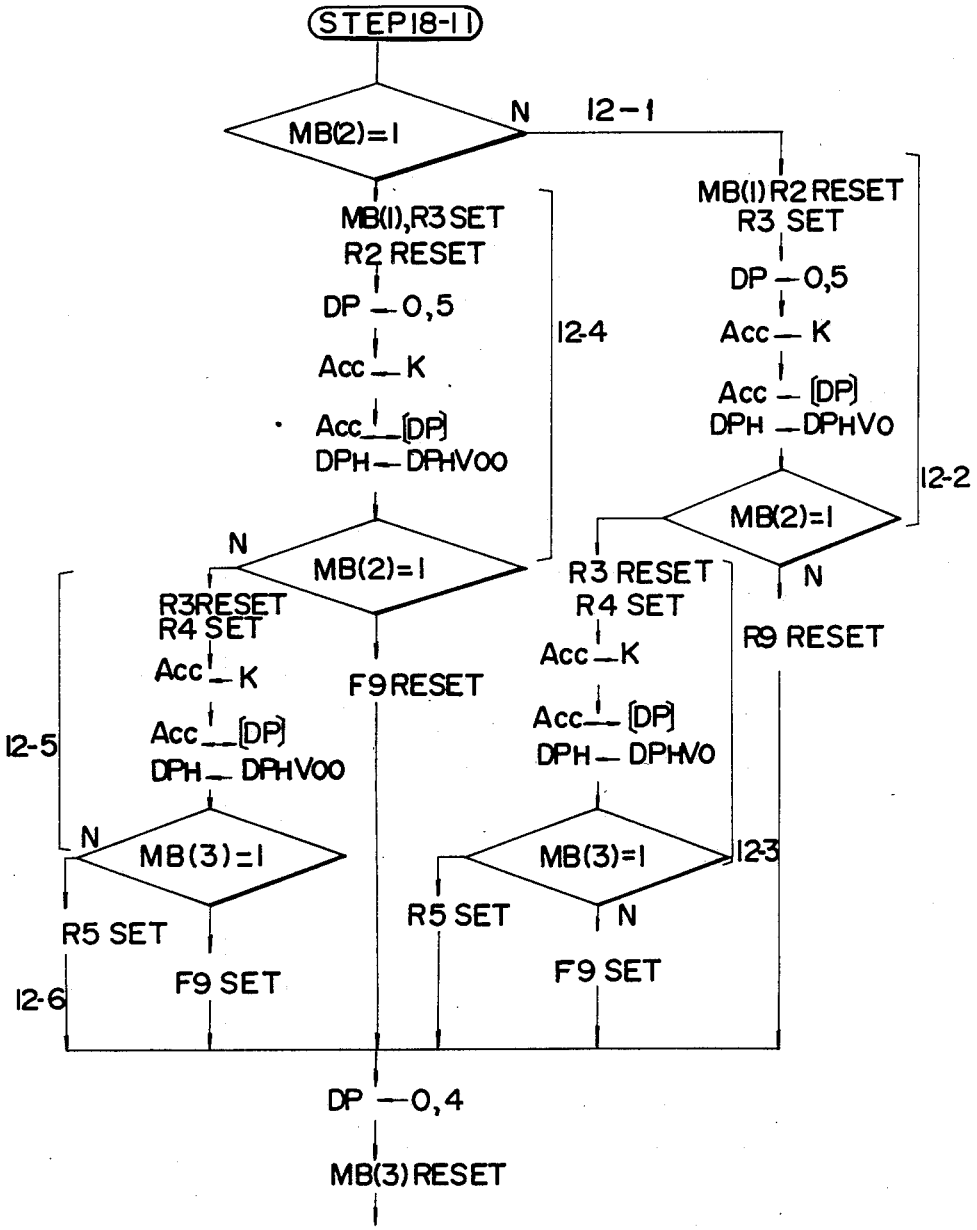

FIG. 13 is a flow chart for shunting and recalling the copy size due to the interruption. The operation can be attained by substituting this flow for the step 18-12 in FIG. 10. In this case, the upper/lower flag, and the upper/lower shunting flag of the RAM addresses (0, 4) are used as the size flag, e.g., when the size is A4, it is "0", and when the size is B4, it is "1". In other words, when the upper cassette is in the A4 or B4 size, the levels 0 and 1 are introduced as inputs into the port $K_2$ by the switch 100. When the lower cassette is in A4 or B4 size, the level 0, 1 are introduced as inputs into the port $K_3$ by the switch 101. The switches 100 and 101 may be microswitches which are turned on and off in accordance with the cassette size, when the cassette is loaded on the reproduction apparatus.

When the interruption key is turned on, the then size flag is checked in the step 18-6 in FIG. 10, thereby setting or resetting the shunting size flag in accordance with the flag. At the completion or stoppage of the interruption copying, the shunting size flag is check-d (12-1). When the size flag is in A4 size, it is reset, thereby resetting and setting the timing ports $R_2$ and $R_3$ respectively to take the data in the port $K_2$ into RAM through the accumulator Acc, and ckecking the second bit (12-2). If the second bit is "0", this means that the A4 size is in the upper cassette, so that the output port F9 is reset to operate the upper rollers 29-1. If the bit is "1", the data in the port $K_3$ is taken thereinto to check the third bit (12-3). If the third bit is "0", the port F9 is set to operate the lower cassette rollers 29-3. If it is "1", the output port $R_5$ is set to turn on the lamp to indicate that there is no cassette of the desired size. At the step 12-1, when the size shunting flag is discriminated to be in B4 size, the upper cassette is first checked to find out whether the B4 size is in it, or not, in the same manner as mentioned above. If B4 size is present, the upper cassette rollers are operated. When the B4 size is not present, the lower cassette is checked for the B4 size. If it is present, the lower cassette rollers are operated (12-5). When the B4 size is not present, the port $R_5$ is set to indicate that no cassette of desired size is present (12-6). In this way, it becomes possible to prevent any mistake in the selection of the copy size such that, even when a cassette of a size different from that of the cassette used before the interruption copying is set at the time of the interruption copying, the copying operation is erroneously done on the copy sheet of the different size after termination of the interruption copying. It is also possible that re-starting of the copying operation is hindered by disabling the copy key entry through setting of the port $R_5$.

What we claim is:

1. An image forming apparatus comprising:

first key means for entering a number corresponding to copying repetitions to be made in a copying operation;

second key means for causing the start of the copying operation of the number of repetitions entered by said first key means;

third key means for interrupting a first copying operation for performing copying repetitions, the number of said copying repetitions being entered with said first key means;

memory means operable during a second copying operation for storing the number of repetitions to be performed to complete the first copying operation, said memory means operating in a case where the first copying operation has been interrupted by said third key means, and operating in a case where said third key means is actuated but the first copying operation has not yet been started and the number of repetitions for the first copying operation has been set to a number other than that of an initial state of said apparatus;

intermediate means for performing and completing the second copying operation for producing a desired number of other copies during an interruption of the first copying operation while said memory means maintains the number of repetitions associated with completion of the first copying operation; and means for starting the first copying operation in accordance with the number stored in said memory means in response to said second key means after completion of the second copying operation caused by said intermediate means during said interruption of the first copying operation, whereby a higher-priority copying operation is effected before a lower-priority copying operation.

2. Apparatus according to claim 1, wherein said intermediate means completes the second copying operation of a single copy in response to actuation of said third and second key means in that order after said first key means has been actuated.

3. Apparatus according to claim 1, wherein said memory means stores the number in response to actuation of said third key means at least until the end of said second copying operation.

4. Apparatus according to claim 1, further comprising means for indicating the number entered by said first key means and a copy count, said memory means storing the number or count indicated by said indicating means after actuation of said third key means.

5. Apparatus according to claim 4, wherein said indicating means indicates the number "1" as a preset copy number after the number of repetitions has been stored in said memory means.

6. Apparatus according to claim 4, wherein said indicating means indicates the number stored in said memory means in response to completion of the second copying operation.

7. Apparatus according to claim 4, wherein said indicating means automatically indicates the number stored in said memory means, when the second copying operation is terminated while in progress.

8. Apparatus according to claim 1, further comprising fourth key means for stopping the continuation of first copying operation, and means responsive to said fourth key means for controlling said intermediate means and said starting means to stop the second copying operation in response to actuation of said fourth key means during performance of the second copying operation caused by second intermediate means and to release the mode for the second copying operation and to recall the number of copies associated with the first copying operation to permit resumption of the first copying operation.

9. Apparatus according to claim 1, further comprising means for generating a signal associated with a malfunction in the apparatus, and means responsive to said malfunction signal generating means for controlling said intermediate means to interrupt the second copying operation in response to a malfunction signal received during performance of the second copying operation caused by said intermediate means to hold the mode for the second copying operation and the number of copies associated therewith, and to permit resumption of the copying operation when the malfunction is removed.

10. Apparatus according to claim 9, further comprising additional key means for releasing the second copying operation mode and for recalling the number of copies associated with the first copying operation.

11. Apparatus according to claim 9, wherein said malfunction includes a jam or storage of copying material.

12. Apparatus according to claim 1, further comprising means for preventing said memory means from operating to effect a further copying operation based on actuation of said third key means during performance of the second copying operation by said intermediate means.

13. Apparatus according to claim 1, further comprising a plurality of copying material feeding units, and additional key means for selecting one of said feeding units or a size of the copying material, said memory means storing data concerning the copying material provided from said additional key means, said intermediate means completing the second copying operation in accordance with data for another desired copying material while said memory means stores the data concerning the copying material for the first copying operation.

14. Apparatus according to claim 13, wherein said starting means starts the first copying operation in accordance with the data concerning the copying material stored in said memory means in response to operation of said second key means after a completion of the second copying operation.

15. Apparatus according to claim 13, wherein said starting means refrains from starting the copying operation when the copying material feeding unit associated with the data concerning the copying material and stored in said memory means prior to the resumption does not contain copying material.

16. Apparatus according to claim 13, wherein said starting means refrains from starting the copying operation when none of said feed units contains copying material associated with the data concerning the copying material stored in said memory means.

17. An image forming apparatus according to claim 1, wherein the number of copying repetitions to be set is performed by actuating said third, first and second key means in that order.

18. An image forming apparatus comprising:

first key means for entering a number corresponding to copying repetitions to be made in a copying operation;

second key means for causing the start of the copying operation of the number of repetitions entered by said first key means;

third key means for interrupting a first copying operation which is performed in response to actuation of said first and second key means;

memory means for storing the number of repetitions to be performed to complete the first copying operation, during an interruption of the first copying operation caused by said third key means, said number of repetitions to be performed being different from that set in an initial state of said apparatus;

operable means for performing and completing a second copying operation for producing a desired number of other copies while said memory means maintains the number of repetitions associated with completion of the first copying operation;

means for resuming the first copying operation in accordance with the number stored in said memory means in response to said second key means after completion of the second copying operation caused by said operable means;

fourth key means for stopping the continuation of the first copying operation while data for said first copying operation is maintained; and means responsive to said fourth key means for controlling said operable means to stop the second copying operation in response to actuation of said fourth key means during performance of the second copying operation caused by said operable means, to cancel the number of copies associated with the second copying operation, to release a mode for the second copying operation and to recall the number of copies associated with the first copying operation to permit the resumption of the first copying operation.

19. Apparatus according to claim 18, further comprising means for indicating the number entered by said first key means and a copy count, said memory means storing the number or count indicated by said indicating means after actuation of said third key means.

20. Apparatus according to claim 19, wherein said indicating means indicates the number "1" as a preset copy number after the number of repetitions has been stored in said memory means.

21. Apparatus according to claim 19, wherein said indicating means indicates the number stored in said memory means in response to the completion of the second copying operation.

22. Apparatus according to claim 19, wherein said indicating means automatically indicates the number stored in said memory means when the second copying operation is terminated while in progress.

23. Apparatus according to claim 18, further comprising means for generating a signal associated with a malfunction in the apparatus, and means, responsive to said malfunction signal generating means, for controlling said operable means to interrupt the second copying operation in response to a malfunction signal received during performance of the second copying operation caused by said operable means, to hold the mode for the second copying operation and the number of copies associated therewith, and to permit resumption of the second copying operation when the malfunction is removed.

24. Apparatus according to claim 18, further comprising means for preventing operating to effect a further copying operation based on actuation of said third key means during performance of the second copying operation by said operable means.

25. Apparatus according to claim 18, further comprising a plurality of copying material feeding units, and additional key means for selecting one of said feeding units or a size of the copying material, said memory means storing data concerning the copying material provided from said additional key means, said operable means completing the second copying operation in accordance with data for another desired copying material while said memory means stores data concerning the copying material for the first copying operation.

26. Apparatus according to claim 25, wherein said resuming means resumes the first copying operation in accordance with the data concerning the copying material stored in said memory means in response to actuation of said second key means after completion of the second copying operation.

27. An image forming apparatus according to claim 18, wherein said operable means comprises operation units for performing copy processes.

28. An image forming apparatus according to claim 27, wherein said operation units perform paper feed, exposure, development, fixing and paper ejection processes.

29. An image forming apparatus comprising:

first key means for entering a number of repetitions for producing copies in a copying operation;

second key means for causing the start of the copying operation of the number of repetitions entered by said first key means;

third key means for interrupting a first copying operation which is performed in response to actuation of said first and second key means;

memory means for storing the number of repetitions to be performed to complete the first copying operation, during an interruption of the first copying caused by said third means;

intermediate means for performing and completing a second copying operation for producing a desired number of other copies while said memory means maintains the number of repetitions associated with the first copying operation;

means for resuming the first copying operation in accordance with the number stored in said memory means in response to actuation of said second key means after completion of the second copying operation caused by said intermediate means;

means for generating a signal associated with a malfunction in the apparatus;

means responsive to said malfunction signal generating means for controlling said intermediate means so as to interrupt the second copying operation in response to a malfunction signal received during performance of the second copying operation caused by said intermediate means to hold the number of copies associated therewith and to permit the second copying operation to resume when the malfunction is removed; and means for cancelling the number of copies associated with the second copying operation, and for recalling the number of copies associated with the first copying operation in accordance with the second entry by said third key means prior to starting the second copying operation so as to cancel the second copying operation and to resume the first copying operation.

30. Apparatus according to claim 29, wherein said cancelling means comprises additional key means for cancelling the number of copies associated therewith during an interruption of the second copying operation caused by said control means.

31. Apparatus according to claim 29, wherein said malfunction consists of a jam or a shortage of copying material, and wherein a flag is set when said first copying operation is interrupted by said third key means.

32. Apparatus according to claim 29, further comprising means for indicating the number entered by said first key means and a copy count, said memory means storing the number or count indicated by said indicating means after actuation of said third key means.

33. An image forming apparatus according to claim 32, where said indicating means indicates the number "1" as a preset copy number after the number of repetitions has been stored in said memory means.

34. Apparatus according to claim 32, wherein said indicating means automatically indicates the number stored in said memory means when the second copying operation is terminated while in progress.

35. An image forming apparatus according to claim 29, wherein said intermediate means comprises operation units for performing copy processes.

36. An image forming apparatus according to claim 35, wherein said operation units perform paper feed, exposure, development, fixing and paper ejection processes.

* * * * *

UNITED STATES PATENT AND TRADEMARK OFFICE

CERTIFICATE OF CORRECTION

PATENT NO. : 4,907,031

DATED : March 6, 1990

INVENTOR(S) : YOSHIHIRO KAWATSURA, ET AL.

It is certified that error appears in the above-identified patent and that said Letters Patent is hereby corrected as shown below:

COLUMN 1

Line 43, "interuption" should read --interruption--.
Line 65, ""pro-" should read --pro- --.
Line 66, "vide"" should read --vide--.

COLUMN 4

Line 30, "display 225 and 226," should read --displays 225 and 226,--.

COLUMN 6

Line 4, "there of." should read --thereof.--.

COLUMN 7

Line 8, "is ?1"" should read --is "1"--.

COLUMN 10

Line 21, "follows" should read --follow--
Line 43, "(1)," should read --"1"--

COLUMN 11

Line 35, "level 0, 1" should read --levels 0, 1--.
Line 44, "check-d" should read --checked--.

UNITED STATES PATENT AND TRADEMARK OFFICE

CERTIFICATE OF CORRECTION

PATENT NO. : 4,907,031

DATED : March 6, 1990

INVENTOR(S) : YOSHIHIRO KAWATSURA, ET AL.

It is certified that error appears in the above-identified patent and that said Letters Patent is hereby corrected as shown below:

COLUMN 13

Line 6, "of first" should read --of the first--.
Line 12, "second intermediate means" should read --said intermediate means--.

COLUMN 15

Line 45, "first copying" should read --first copying operation--.
Line 46, "said third means;" should read --said third key means;--.

COLUMN 16

Line 38, "where" should read --wherein--.

Signed and Sealed this

Nineteenth Day of November, 1991

*Attest:*

HARRY F. MANBECK, JR.

*Attesting Officer*

*Commissioner of Patents and Trademarks*